US006880562B2

(12) United States Patent
Lynn

(10) Patent No.: US 6,880,562 B2
(45) Date of Patent: Apr. 19, 2005

(54) BEARING CLEANING SYSTEM AND METHOD WITH LID ATTACHED SUSPENSION

(76) Inventor: Edward W. Lynn, 3603 NE. 115$^{th}$ Cir., Vancouver, WA (US) 98686

( * ) Notice: Subject to any disclaimer, the term of this patent is extended or adjusted under 35 U.S.C. 154(b) by 133 days.

(21) Appl. No.: 10/310,464

(22) Filed: Dec. 4, 2002

(65) Prior Publication Data

US 2004/0107978 A1 Jun. 10, 2004

(51) Int. Cl.$^{7}$ ..... B08B 3/04
(52) U.S. Cl. ..... 134/117; 134/135
(58) Field of Search ..... 134/116, 117, 134/135, 166 R, 169 A

(56) References Cited

U.S. PATENT DOCUMENTS 2,362,251 A * 11/1944 Eggleton ..... 401/129
2,652,350 A * 9/1953 Dailey ..... 134/23
5,863,350 A * 1/1999 Lekavich ..... 134/23
5,941,260 A * 8/1999 Wershe ..... 134/117
6,058,948 A * 5/2000 Wershe ..... 134/117

* cited by examiner

*Primary Examiner*—Michael Barr
*Assistant Examiner*—Saeed Chaudhry
(74) *Attorney, Agent, or Firm*—Donald W. Meeker

(57) ABSTRACT

A jar fillable with cleaning fluid has a lid with a suspension system for roller bearings hanging from the inside of the lid. On each of two or more suspension systems, bearings are interwoven between two sides of an overlapping plastic tie looped through a securing loop in the lid. Any desired number of bearings of various sizes and shapes are secured, with a synching of the tie at the bottom, in an alternating array with all bearings parallel, no bearings touching, and each bearing positioned to receive a flow of cleaning fluid through it. The container is shaken in a direction perpendicular to each bearing for maximum cleaning. The bearings are installed by screwing on the lid and removed by removal of the lid.

6 Claims, 2 Drawing Sheets

BEARING CLEANING SYSTEM AND METHOD WITH LID ATTACHED SUSPENSION

BACKGROUND OF THE INVENTION

1. Field of the Invention

The present invention relates to cleaning systems for bearings used in inline skates, quad skates, skateboards and other similar bearings, and in particular to a bearing cleaning system having a suspension system attached to the lid of a jar containing cleaning fluid which maintains the bearings in separated positions elevated above the bottom of the jar above the residue and aligned so that the movement of the cleaning fluid is through the bearings for more efficient and thorough cleaning for all types of bearings, including "junior bearings".

2. Description of the Prior Art

Bearings for inline skates, quad skates, skateboards, and other related recreational equipment are continually exposed to dirt which builds up inside the precision bearing sticking to the grease or oil used to lubricate the bearings. If the bearings are not cleaned periodically they will wear out much more quickly from the abrasion caused by the dirt and other particles. Also the bearings do not function as well when they are dirty slowing down the rolling motion. People in competitions and races often clean their bearings before every event for maximum performance.

Existing bearing cleaning products commonly found in the marketplace include preloaded jars of solvent. You place the bearings in the jar with the solvent, tighten down the lid and shake the jar until the bearings are clean. The bearings are typically loosely stacked on each other on the bottom of the jar or raised up slightly by an internal mechanism.

The main problem with existing products is that the bearings are not secure. During the cleaning process the bearings are shaken, causing the bearings to bang into each other and potentially damaging the precision bearings. Because the bearings rub and rattle against each other inside the jar, you can not shake the jar as vigorously. Thus it takes longer to degrease and clean the bearings.

Another problem with existing products is that bearing inspection during the cleaning process is difficult for two reasons. First, you must pull the bearings out of the bottom of the jar. Sometimes there is a mechanism for doing so, but most often there is no mechanism, which makes the process very inconvenient. Second, in most cases the user must touch the degreaser in order to pull the bearings up for inspection. Coming into contact with the degreaser is not desirable, as the solvent is usually toxic, flammable and smelly.

Another problem with existing products is that the bearings are not oriented to take advantage of the splashing or motion of the cleaning solvent.

Another problem with existing products is that the cleaning kits may support the cleaning of one size of bearing and not support different size bearings that are now being used on inline skates, quad skates and skate boards. The existing products may be dependent on either the inside bearing diameter or outside bearing diameter. Several different bearing sizes are now used where both the inner diameter and outer diameter or both are different from the standard bearing used in the past. Inline skates may have a different size bearing depending on the manufacturer's preference and use of the skate. Skates manufactured from the same manufacturer may use different size bearings for their different skates. Quad skates typically have a different size bearing from inline skates and "junior" bearings on kids' skates are altogether different in size and shape and have an additional bearing spacer (axle) built into it. Prior art bearing cleaners cannot accommodate the diverse size range of bearings that are used.

Another problem with existing products is that the cleaning kits will not support a variable number of bearings and will work only with a specific number of bearings. It is not always desirable to clean the same number of bearings.

To summarize the problems with existing patented items: bearings lie loosely in the container; bearings are difficult to inspect during the cleaning process; bearings are not oriented in one direction to maximize the effect of agitating the solvent: existing kits may not support different size bearings used on today's inline skates, quad skates, kids' skates, and skateboards; existing kits my not support different number of bearings. Many of the bearing cleaning systems are overly complex and somewhat expensive and still don't solve the problem effectively.

U.S. Pat. No. 5,297,569, issued Mar. 29, 1994 to McLain shows a method and apparatus for cleaning and lubricating bearings includes the steps of placing the bearings on posts on a rotating member, and rotating the member within a container containing a cleaning solvent. The rotating member is then removed from the cleaning solvent, and a lubricant is placed within the container. The rotating member is then reinserted into the container and the bearings are rotated within the lubricant.

U.S. Pat. No. 2,823,682, issued Feb. 18, 1958 to Coulter, claims a cleaning method and apparatus, and more particularly, a means for cleaning bearings, comprising a container for holding a quantity of cleaning fluid, a lid mounted on the top of said container, a vertically disposed hollow standard depending from said lid, a conduit extending down through dais standard and adapted to be connected to a source of supply of air under pressure, a plurality of horizontally disposed arms secured to the lower end of said standard, a vertically disposed finger extending upwardly from the outer end of each of said arms, a sleeve, rotably supported by each of said fingers, a frustro-conical support member supported by each of said sleeves and provided with a lower annular lip for supporting tubes connected to said conduit for supplying air only the bearings, said air being directed tangentially onto the bearings being cleaned.

U.S. Pat. No. 6,058,948, issued May 9, 2000 to Wershe, is for a bearing cleaning apparatus containing a cage assembly, bottle, and cap. The cage assembly includes rectangular-shaped vertical side arms which define one or more channels in which one or more circular bearings may be placed. The cage assembly contains perforations to facilitate solvent flow through the bearings and through the cage assembly. The cage assembly also includes shoulders at the bottom of the assembly, a closure mechanism at the top of the assembly, and flanges in order to prevent the bearings from exiting the cage assembly during cleaning.

U.S. Pat. No. 5,941,260, issued Aug. 24, 1999 to Wershe, illustrates a bearing cleaning apparatus containing a cage assembly, bottle, and cap. The cage assembly includes rectangular-shaped vertical side arms shaped so as to form one or more channels in which one or more circular bearings may be placed. The cage assembly contains perforations along the inner base surface in order to facilitate solvent flow through the bearings and the cage assembly. The cage assembly also includes shoulders at the bottom of the assembly, a closure mechanism at the top of the assembly, and flanges in order to prevent the bearings from exiting the cage assembly during cleaning.

U.S. Pat. No. 5,863,350, issued Jan. 26, 1999 to Lekavich, indicates a bearing cleaning method and accompanying kit, which allows for the cleaning of roller blade wheel bearings. By following a succession of steps in cooperation with a kit comprising a modular stacking unit and container and closely sized to receive the unit, a user can quickly and easily clean a plurality of roller blade wheel bearings agitating an organic solvent partially filling the container. A plurality of roller blade wheel bearings are stacked within a modular stacking unit comprising a multitude of cylindrical spacing elements, a pair of planar end caps, with each planar end cap including two integral spacing elements, and a resilient band member. The modular stacking unit, once assembled, is placed within the interior volume of a container, along with a small quantity of organic solvent. After agitating the container by hand, the modular stacking unit is removed from the interior volume of the container and rolled, in a back and forth motion, along a flat, absorbent surface in order to dry the roller blade wheel bearings. The modular stacking unit is then disassembled permitting the individual roller blade wheel bearings to be lubricated and reinserted within a roller blade wheel.

U.S. Pat. No. 2,652,350, issued Sep. 15, 1953 to Dailey, relates to an apparatus and method for cleaning anti-friction bearings of the ball or roller type, which may be used in cleaning new bearings and used bearings which have been lubricated with oil or grease. The cleaning device consists of a power-driven shaft or rotor upon which the bearings are held and which is positioned vertically in a contained. The container holds any suitable cleaning solution. Bearings mounted on the rotor are rotated at high speeds in the hot cleaning solution. When removed, the cleaning solution quickly evaporates.

U.S. Pat. No. 2,652,843, issued Sep. 22, 1953 to Schuchman, et al., shows a device for cleaning bearings, and relates particularly to a bearing cleaner constructed in such manner as to cause rotation of the bearing while the latter are being subjected to the action of cleaning fluid.

U.S. Pat. No. 3,482,583, issued Dec. 9, 1969 to Schipke, puts forth an apparatus for cleaning a ball bearing assembly that provides for placing the assembly in a bath of cleaning liquid subjected to ultrasonic vibrations and moving the bearing assembly as a unit to different positions in the bath while rotating one of the races.

U.S. Pat. No. 5,678,582, issued Oct. 21, 1997 to McClure, is for improved maintenance of skate bearings by means of a hand-tool adapted to rotate the ball bearings of an annular bearing assembly immersed in cleansing liquid to remove lubricant and contaminants. The tool is adapted to hold the outer annular race member of such a bearing assembly fixed and to hold the inner annular race member via its open center for rotation relative to the outer race member, thus rotating the ball bearings in the bearing assembly. Such rotational cleaning is conducive to extending the useful life of the bearings when subsequently re-oiled and re-installed in a skate wheel.

What is needed is an inexpensive and convenient system for cleaning different number of bearings, different sized bearings, which elevates, separates, secures, and aligns the bearings above the bottom of the cleaning container and which also has a means for removing or inspecting the bearings without coming into contact with the toxic cleaning fluid.

SUMMARY OF THE INVENTION

The main object of the present invention is to provide a bearing suspension system that aids in cleaning and degreasing small roller bearings typically used in, but not limited to, inline skates, quad skates, kids' skates and skate boards.

Another primary object of the present invention is to provide an inexpensive and convenient system for cleaning bearings which elevates, separates, secures, and aligns the bearings above the bottom of the cleaning container.

Another major object of the present invention is to provide a means for removing and installing the bearings without contacting the toxic cleaning fluid Another object of the present invention is to reduce bearing damage by providing a device that holds bearings securely so they do not bang into each other during the cleaning process.

Another object of the present invention is to provide a bearing suspension system that holds the bearings away from the bottom of the cleaning jar. When foreign matter falls from the bearings, it settles to the bottom of the jar away from the bearings.

Another object of the present invention is to secure the bearings in an alternating array so that they do not obstruct the internal roller balls and ball retainers of other bearings. This improves the cleaning contact between the solvent and bearings.

Another object of the present invention is to orient the bearings so that during the cleaning process the back and forth shaking motion maximizes the flow of cleaning solution through the bearings in the most effective direction.

Another object of the present invention is to provide a bearing suspension system that supports all sizes of roller bearings used in inline skates, quad skates, kids' skates and skateboards.

Another object of the present invention is to provide a bearing suspension system that makes it easy to inspect the bearings during the cleaning process and without coming into contact with the solvent since the bearings are attached by the suspension system to the lid of the cleaning jar and lifting the lid lifts the bearings out of the cleaning solution.

Another object of the present invention is to provide a bearing suspension system that holds and secures different size bearings commonly used on inline skates, quad skates, kids' skates, and skateboards. A skater for an example may use a larger bearing for general recreation and use a mini bearing for racing. This same skater may use yet another size bearing for his quad skates.

Another object of the present invention is to provide a bearing suspension system that holds and secures different number of bearings. 1 to 20 bearings can be secured and cleaned. It is not always desirable to clean the same number of bearings each time.

In brief, the purpose of the present invention is for degreasing and cleaning roller bearings typically used, but not limited to, inline skates, quad skates, kids' skates, and skateboards. Bearings are subjected to a vigorous shaking in a citrus degreaser solution. The bearing suspension system secures the bearings in order to thoroughly clean and degrease the bearings.

The main components of the present invention include a bearing suspension system that is attached to the lid of a cleaning jar that holds different size and number of bearings securely, separated, properly orientated, and suspended from the top of the cleaning jar away from and out of contact with the bottom of the cleaning jar.

The bearing cleaning kit is comprised of a straight-sided plastic jar with a lid that can seal completely. Attached to the under side of the lid is a pair of bearing suspenders. The bearing suspenders are designed to hold securely 1 to 10 bearings each. A total of 20 bearings can be cleaned at the same time. Each suspender is attached to the lid slightly off center and is made of a pair of nylon tie wraps that can be secured together at the ends. Bearings are secured to each pair of suspenders by following a bearing loading sequence.

The bearing suspension system is designed to hold and secure the different size bearings in an orientation to maximize the cleaning effect in several ways.

1. The bearings are held securely so they do not bang into each other during the cleaning process, thereby reducing bearing damage.
2. The bearings are held such that they do not obstruct each other's internal roller balls and ball retainers. This is important to maximize the cleaning effect and is an improvement to other prior art bearing cleaners.
3. The bearings are held such that during the cleaning process you will notice that the bearings are orientated so that the back and forth shaking motion splashes through the bearings. This is important to minimize the effort needed to clean the bearings and is an improvement to other prior art bearing cleaners.

BRIEF DESCRIPTION OF THE DRAWINGS

These and other details of my invention will be described in connection with the accompanying drawings, which are furnished only by way of illustration and not in limitation of the invention, and in which drawings.

BEST MODE FOR CARRYING OUT THE INVENTION

Figure 1:
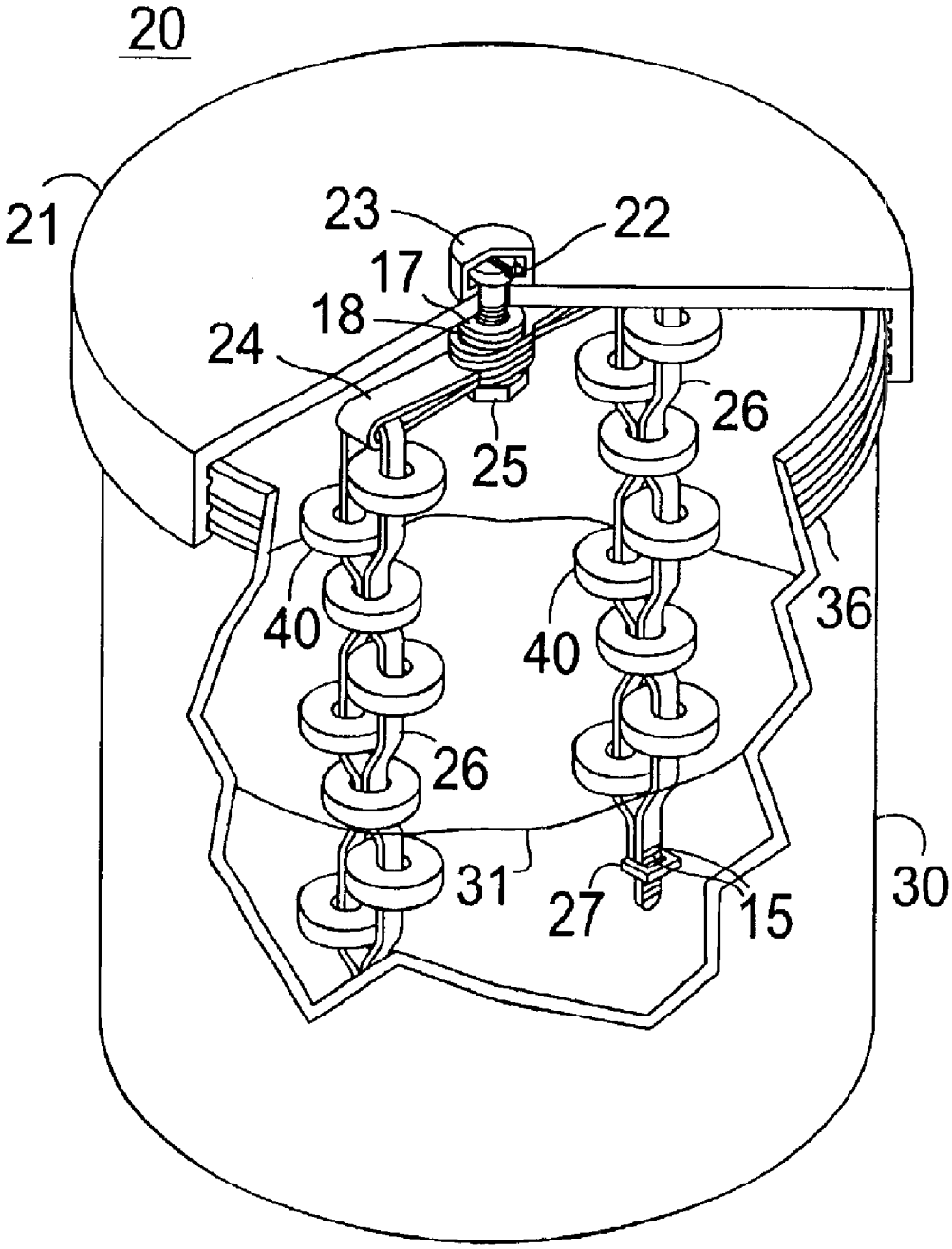
FIG. 1 is a broken perspective view showing the bearing cleaning container with the lid on the container and the bearings suspended from the lid on two spaced suspension systems.
Figure 2:
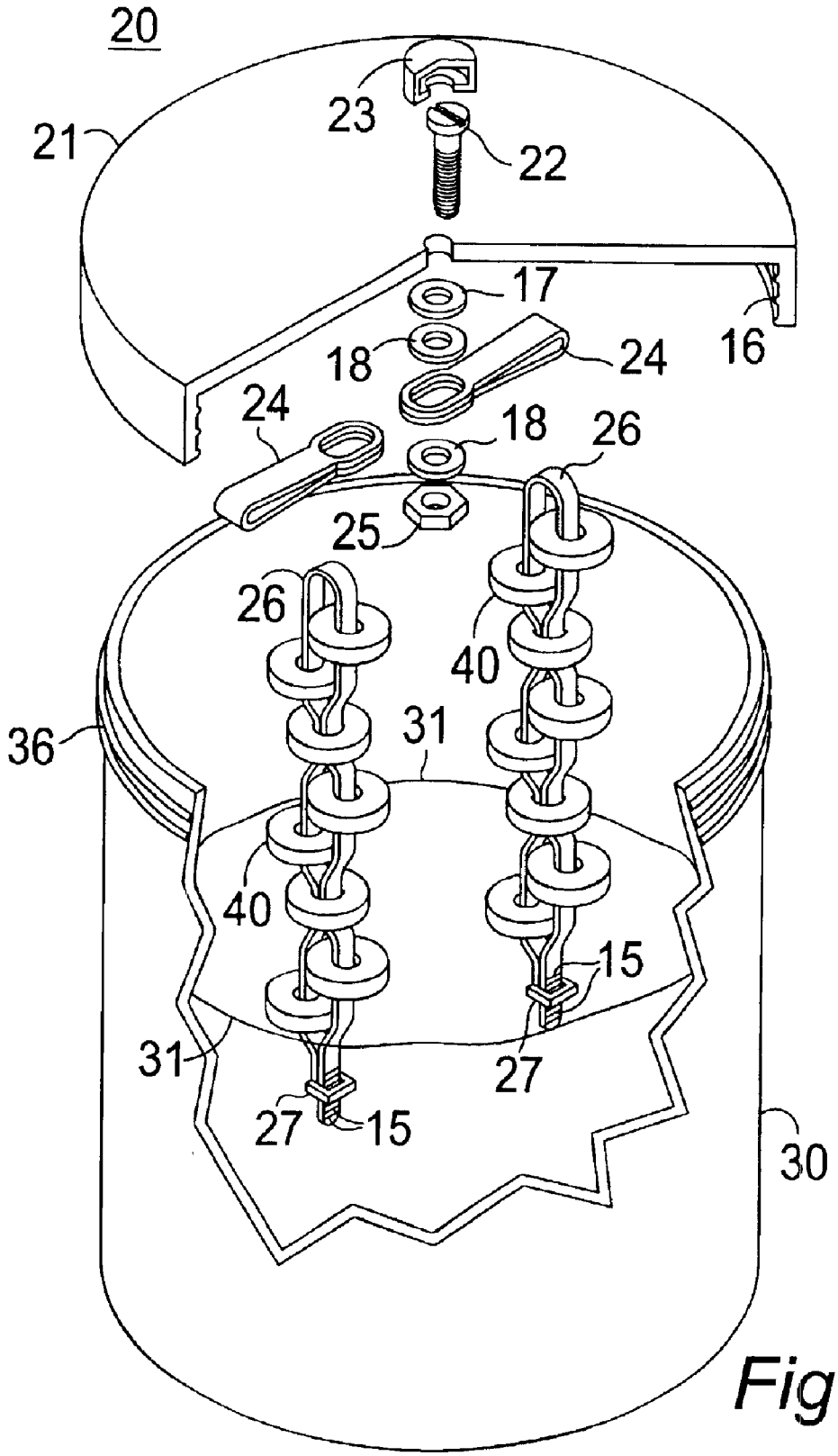
FIG. 2 is a broken perspective partially exploded view showing the parts of the suspension system aligned for attachment to the lid.

In FIGS. 1 and 2, a bearing cleaning system, which could be in the form of a bearing cleaning kit, comprises a cleaning jar or container 30 for receiving a quantity of a cleaning fluid 31 therein and a sealable lid 21 for the container, so that the container is capable of being shaken without spilling the cleaning fluid. Preferably, a 16 fl oz cylindrical, plastic jar with a tight fitting screw-on lid 21 is used with threads 16 that mate with the container threads 36. Cleaning fluid is provided in a separate container to allow changing the cleaning fluid easily without having to buy another container to get more cleaning fluid.

A suspension system is attached to and suspended from an interior surface of the lid 21. The suspension system comprises at least one pair of spaced elongated stiff flexible members, such as plastic ties 26, capable of retaining a series of bearings 40 in a spaced alternating array on the ties 26 so that the bearings do not bang together upon shaking the container in a cleaning motion, so that the bearings are suspended above the bottom of the container away from residue which accumulates on the bottom of the container, and so that the bearings are all aligned in a direction to receive a maximum of flow of the cleaning fluid through the bearings upon shaking the container, and so that the bearings may be lowered into the container by installation of the lid on the container and the bearings may be removed from the container by lifting the lid from the container.

There is at least one pair of elongated stiff flexible members and preferably two, each comprising a long plastic tie 26, as is commonly used as a binding means in packing, having a self closing means of connecting the ends of the tie, such as a first end having raised spaced cross lines 15 sliding with an adjustable snap fit on each of the lines into a slotted receptacle 27 at the second end. Each tie 26 is inserted through a loop 24 attached to the lid 21 by a screw 22 with a screw cap 23 and a nut 25 through a lid hole 16 as a securing means having metal washers 18 and a rubber washer 17 to seal the lid hole 16, so that the two ends of the tie hang down side by side and the tie 26 is capable of receiving a series of bearings 40 installed on the two sides of the tie in a pattern with the bearings secured in a staggered array all parallel but staggered out of alignment with each other, with the ends of the tie interconnected by the self closing means 27 to retain the bearings thereon.

The alternating array is formed with a first bearing positioned with a first side of the tie passing through a center opening in the first bearing, a second subsequent bearing is positioned with a second side of the tie passing through a center opening in the second bearing, and a third subsequent bearing is positioned with both the first and the second sides of the tie passing through a center of the third bearing and the subsequent bearings repeating the pattern and with the self securing means 27 synched up tight on a bottom bearing to create a binding effect for maintaining the relative offset positions of the bearings, the tie 26 being capable of maintaining the relative offset positions of the bearings during shaking of the container preventing the bearings from banging together.

Each plastic tie can hold a variable number of bearings from 1 up to the number of bearings that will fit on a given length of tie. In the example given above with a 16 oz jar and two ties, from 1 to 20 bearings may be cleaned at a time. For different sizes of jars with different lengths and different numbers of ties, the maximum number can vary accordingly.

In practice, a bearing cleaning method comprises:

a first step of placing a quantity of a cleaning fluid 31 in a container 30 for receiving the cleaning fluid therein, the container having a sealable lid 21;

a second step of attaching a suspension system to and suspending the system from an interior surface of the sealable lid 21, the suspension system comprising at least one pair of spaced elongated flexible members, such as ties 26, capable of retaining a series of bearings 40 in a spaced array so that the bearings do not bang together upon shaking the container in a cleaning motion, so that the bearings are suspended above the bottom of the container away from residue which accumulates on the bottom of the container, so that the bearings are all aligned in a direction to receive a maximum of flow of the cleaning fluid through the bearings upon shaking the container, and so that the bearings may be lowered into the container by installation of the lid 21 on the container 30 and the bearings 40 may be removed from the container by lifting the lid 21 from the container 30;

a third step of placing the sealable lid 21 on the container while simultaneously lowering the bearings 40 on the ties 26 into the container 30 and sealing the container with the sealable lid 21 so that the container is capable of being shaken without spilling the cleaning fluid;

and a fourth step of shaking the sealed container 21 in a direction perpendicular to the bearings 40.

The long plastic ties 26, each have a self closing means of connecting the ends of the tie, by inserting the first end with raised spaced transverse parallel lines into the slotted receptacle 27 of the other end, and the second step in detail comprises inserting each tie 26 through the loop 24 attached to the lid 21 so that the two ends of the tie hang down side by side and installing a series of bearings 40 on the two sides of the tie in a staggered pattern with the bearings secured in a staggered array all parallel but staggered out of alignment with each other, interconnecting the ends of the tie by the self closing means to retain the bearings thereon.

In further detail, the second step further comprises positioning a first bearing with a first side of the tie passing through a center opening in the first bearing, positioning a second subsequent bearing with a second side of the tie passing through a center opening in the second bearing, and positioning a third subsequent bearing with both the first and the second sides of the tie passing through a center of the third bearing and positioning a series of subsequent bearings repeating the pattern and synching up the self securing means tight on a bottom bearing to create a binding effect for maintaining the relative offset positions of the bearings, the tie being capable of maintaining the relative offset positions of the bearings during shaking of the container preventing the bearings from banging together.

The system and method preferably comprise at least a pair of ties 26 each inserted through a loop 24 attached to the lid and the second step comprises installing at least two sets of offset bearings suspended from the lid. It is understood that more ties 26 may be utilized in conjunction with more loops 24 particularly with a larger container.

To install the bearings for cleaning it is first necessary to remove the shields or seals from the bearings 40. The system and method work best by laying the lid 21 upside down on a table with the bearing suspension system, the ties 26 already positioned in the loops 24 attached to the lid 21 so that the ties 26 are sticking up with the ends disconnected.

The following sequence may be used to load up to 10 bearings for each tie:

1. Place the pointed end of the tie wrap with the lines 15 through the center of one bearing 40 and slide the bearing all the way down towards the lid 21.
2. Place the fastener 27 end of the tie wrap through a second bearing 40 and slide it down the tie.
3. Place both ends of the tie wrap through a third bearing 40 and again slide it down the tie.

Repeat these 3 steps for the remainder of the bearings up to 10 bearings per tie wrap pair for a 16 oz jar with a full length tie therein.

After loading the bearings, connect the ends of the tie 26 tightly so the bearings 40 are held snug and secure. Ten more bearings may be loaded on the other tie 26. The second tie can be left empty as well.

Pour a quantity of cleaning fluid 31 into the container 30 sufficiently deep to cover all the bearings on the suspension systems.

The bearings 40 on the ties 26 are lowered into the cleaning solution and the lid 21 screwed on tightly. The container 30 is rotated 90 degrees onto its side and shaken back and forth horizontally, not up and down. This reduces the movement of the bearings in the jar and maximizes degreasing by splashing the solvent through the bearings in an effective direction.

If the bearings were previously lubricated with thin oil then the cleaning process will go quickly with 10 minutes of shaking accomplishing the cleaning. If the bearings were previously lubricated with a thicker gel then it will take longer to dislodge and dissolve the old grease lubrication. It may take 3 periods of, 5 minutes shaking, 5 minutes soaking. The cleanliness of the bearings may be inspected by unscrewing the lid 21 and lifting it up just enough to see the bearings 40 clearly. If there are any signs of old grease, the lid should be screwed back on and the shaking/soaking process repeated a couple more times or until the bearings appear clean.

The lid 21 is then unscrewed and the container 30 and the lid 21 containing the bearings 40 are then held under running water to thoroughly rinse all traces of cleaner. The water runs off the bearings very nicely and the bearings will be sparkling clean.

The bearings 40 are removed from each tie 26 and placed on a paper towel. It is very important that the bearings be dried thoroughly to avoid rust. A hair dryer or similar drying means may be used to blow them completely dry. During the drying process, the bearings should be turned over. The heated bearing will aid in the evaporation of the moisture. Each bearing should be given a small spin and given a little more time with the hair dryer. When the method is finished the bearings will be clean and free spinning. The bearings should be lubricated and the shields or seals replaced.

It is understood that the preceding description is given merely by way of illustration and not in limitation of the invention and that various modifications may be made thereto without departing from the spirit of the invention as claimed.

What is claimed is:

1. A bearing cleaning system comprising:

a container for receiving a quantity of a cleaning fluid therein and a sealable lid for the container, so that the container is adapted for being shaken without spilling the cleaning fluid;

suspension system attached to and suspended from an interior surface of the lid, the suspension system comprising at least one pair of spaced elongated stiff flexible members adapted for retaining a series of bearings in a spaced array so that the bearings do not bang together upon shaking the container in a cleaning motion, so that the bearings are suspended above the bottom of the container away from residue which accumulates on the bottom of the container, and so that the bearings are all aligned in a direction to receive a maximum of flow of the cleaning fluid through the bearings upon shaking the container so that the bearings may be lowered into the container by installation of the lid on the container and the bearings may be removed from the container by lifting the lid from the container;

wherein the at least one pair of elongated stiff flexible members comprises a long plastic tie having a self closing means of connecting the ends of the tie, the tie being inserted through a loon attached to the lid so that the two ends of the tie hang down side by side and the tie is adapted for receiving a series of bearings installed on the two sides of the tie in a staggered pattern with the bearings secured in a staggered array all parallel but staggered out of alignment with each other, with the ends of the tie interconnected by the self closing means to retain the bearings thereon.

2. The system of claim 1 wherein a first bearing is positioned with a first side of the tie passing through a center opening in the first bearing, a second subsequent bearing is positioned with a second side of the tie passing through a center opening in the second bearing, and a third subsequent bearing is positioned with both the first and the second sides of the tie passing through a center of the third bearing and the subsequent bearings repeating the pattern and with the self securing means synched up tight on a bottom bearing to create a binding effect for maintaining the relative offset positions of the bearings, the tie being adapted for maintaining the relative offset positions of the bearings during shaking of the container preventing the bearings from banging together.

3. The system of claim 2 comprising at least a pair of ties each inserted through a loop attached to the lid to enable at least two sets of offset bearings suspended from the lid.

4. A bearing cleaning kit comprising:

a container for receiving a quantity of a cleaning fluid therein and a sealable lid for the container, so that the container is adapted for being shaken without spilling the cleaning fluid;

a suspension system attached to and suspended from an interior surface of the lid, the suspension system comprising at least one pair of spaced elongated stiff flexible members adapted for retaining a series of bearings in a spaced array so that the bearings do not bang together upon shaking the container in a cleaning motion, so that the bearings are suspended above the bottom of the container away from residue which accumulates on the bottom of the container, and so that the bearings are all aligned in a direction to receive a maximum of flow of the cleaning fluid through the bearings upon shaking the container so that the bearings may be lowered into the container by installation of the lid on the container and the bearings may be removed from the container by lifting the lid from the container;

wherein the at least one pair of elongated stiff flexible members comprises a long plastic tie having a self closing means of connecting the ends of the tie, the tie being inserted through a loop attached to the lid so that the two ends of the tie hang down side by side and the tie is adapted for receiving a series of bearings installed on the two sides of the tie in a staggered pattern with the bearings secured in a staggered array all parallel but staggered out of alignment with each other, with the ends of the tie interconnected by the self closing means to retain the bearings thereon.

5. The kit of claim 4 wherein a first bearing is positioned with a first side of the tie passing through a center opening in the first bearing, a second subsequent bearing is positioned with a second side of the tie passing through a center opening in the second bearing, and a third subsequent bearing is positioned with both the first and the second sides of the tie passing through a center of the third bearing and the subsequent bearings repeating the pattern and with the self securing means synched up tight on a bottom bearing to create a binding effect for maintaining the relative offset positions of the bearings, the tie being adapted for maintaining the relative offset positions of the bearings during shaking of the container preventing the bearings from banging together.

6. The kit of claim 5 comprising at least a pair of ties each inserted through a loop attached to the lid to enable at least two sets of offset bearings suspended from the lid.

* * * * *